US005615786A

United States Patent [19]

Hoyon et al.

[11] Patent Number: 5,615,786

[45] Date of Patent: Apr. 1, 1997

[54] ARTICULATED COUPLING AND A METHOD OF ABSORBING ENERGY BETWEEN TWO RAIL VEHICLES

[75] Inventors: Christophe Hoyon, Ferrieres d'Aunis; Michel Cros, La Jarne, both of France

[73] Assignee: GEC Alsthom Transport SA, Paris, France

[21] Appl. No.: 388,426

[22] Filed: Feb. 14, 1995

[30] Foreign Application Priority Data

Feb. 15, 1994 [FR] France ..... 94 01690

[51] Int. Cl.[6] ..... B61D 49/00

[52] U.S. Cl. ..... 213/75 R; 105/3; 105/4.1

[58] Field of Search ..... 105/3, 4.1, 4.2, 105/4.3; 213/75 R, 7; 280/408

[56] References Cited

U.S. PATENT DOCUMENTS

| | | | |
|---|---|---|---|
| 798,629 | 9/1905 | Sattler | 105/4.1 |
| 1,459,250 | 6/1923 | Pflager | 105/4.1 |
| 2,051,958 | 8/1936 | Madison | 105/3 |
| 5,271,678 | 12/1993 | Bourgeot | 105/3 |
| 5,456,185 | 10/1995 | Rother et al. | 105/2 |

FOREIGN PATENT DOCUMENTS

| | | | |
|---|---|---|---|
| 343482 | 11/1989 | European Pat. Off. | 105/4.1 |
| 2398651 | 2/1979 | France . | |
| 1605130 | 5/1970 | Germany | 105/3 |
| 2100792 | 8/1971 | Germany | 105/4.1 |
| 2054707 | 5/1972 | Germany | 213/75 R |

*Primary Examiner*—Mark T. Le
*Attorney, Agent, or Firm*—Sughrue, Mion, Zinn, Macpeak & Seas

[57] ABSTRACT

An articulated coupling is effected between two vehicles A and B supported on a common bogey between the vehicles. The coupling includes a toroidal part connected to one of the vehicles A and a support part connected to the other vehicle B. A cylindrical pivot is fixed on a soleplate and engaged in a cylindrical bore. A toroidal coupling element is fixed on the soleplate and provides articulated coupling between the soleplate and the toroidal part. An energy absorption system is disposed between first or second cylindrical outside surfaces of the toroidal part and the facing surface of the support part. A shear system holding the support part secured to a longitudinal translation system which is fixed to a support arm connected to the other vehicle shears to prevent damage to the toroidal coupling element, with excessive force being absorbed by the energy absorption system. The present invention is also directed to a method of absorbing energy between two vehicles.

15 Claims, 9 Drawing Sheets

ARTICULATED COUPLING AND A METHOD OF ABSORBING ENERGY BETWEEN TWO RAIL VEHICLES

The present invention relates, in general, to devices for linking together vehicles, in particular rail vehicles, to make up an articulated train, and more particularly it relates to an articulated coupling between two vehicles, in particular rail vehicles.

The invention also relates to a method of absorbing energy between two vehicles, in particular rail vehicles.

BACKGROUND OF THE INVENTION

Articulated couplings on a shared bogey comprise a soleplate associated with one of the vehicles, supported by the shared bogey via springs, and carrying a ball member via elastomer members, with the top surface of the ball member supporting a socket bearing surface that is associated with the other vehicle.

Such articulated couplings comprising spherical surfaces require a great deal of machining.

In addition, they are expensive and relatively heavy.

Document EP-A-0 279 245 in the name of the Applicant describes a device for linking together two rail vehicles that allows the bodies of the vehicles to rotate relative to each other about both a vertical axis and a horizontal axis, which device also defines a gangway compartment interconnecting the two bodies, the compartment comprising two elements that are interconnected by a flexible link, each element being hinged relative to the adjacent body about a vertical axis in common therewith.

The link device described does not include a carrying bogey, and the hinge between each of its elements and the corresponding body is provided by a high-position ball and a convex sector at the end of the body sliding inside a concave sector at the end of the element.

Documents DE-A-1 094 289 and U.S. Pat. No. 3,667,820, and more particularly document EP-A-0 343 482 in the name of the Applicant, describe an articulated coupling for two rail vehicles supported on a shared bogey between the two rail vehicles and comprising:

- a toroidal part connected to one of the vehicles having a frustoconical surface in its lower portion and a cylindrical surface in its upper portion, thereby defining first and second cylindrical outside surfaces, and including a cylindrical bore in its center;
- a support part connected to the other vehicle, including in its upper portion first and second inside cylindrical portions respectively facing said cylindrical outside surfaces of the upper portion of said toroidal part and surrounding said toroidal part by means of a soleplate situated at a level below said toroidal part;
- a cylindrical pivot fixed on said soleplate and engaged in said cylindrical bore; and
- a toroidal coupling element fixed on said soleplate and providing articulated coupling between said soleplate and said toroidal part.

The articulated couplings for two rail vehicles described in the prior art documents do not make it possible to maintain mechanical links between the bodies of the rail vehicles and the structures of the vehicles while also absorbing energy in the event of minor collisions.

The articulated couplings for two rail vehicles described in the prior art documents have the drawback of being rigid and therefore of suffering damage in the event of minor collisions.

OBJECTS AND SUMMARY OF THE INVENTION

Thus, an object of the invention is to provide an articulated coupling for two vehicles, in particular rail vehicles, making it possible to protect the structures of the rail vehicles and the link device between the vehicles in the event of minor collisions or when one train bumps another at a speed exceeding authorized limits.

Another object of the invention is to provide an articulated coupling for two vehicles, in particular rail vehicles, making it possible to prevent the rail vehicles becoming uncoupled.

According to the invention, an articulated coupling between two vehicles A and B, in particular rail vehicles, comprises energy absorption means disposed between one and/or the other of said two vehicles A and B and a component element of said articulated coupling.

According to the invention, an articulated coupling between two vehicles A and B, in particular rail vehicles, with the coupling resting on a shared bogey between said two vehicles, comprises:

- a toroidal part connected to one of the vehicles A, having a frustoconical surface in its lower portion, and a cylindrical surface in its upper portion, thereby defining first and second cylindrical outside surfaces, and including a cylindrical bore in its center;
- a support part connected to the other vehicle B, including an inside cylindrical portion in its upper portion facing said cylindrical outside surface of the upper portion of said toroidal part and surrounding said toroidal part by means of a soleplate situated at a level below the level of said toroidal part;
- a cylindrical pivot fixed on said soleplate and engaged in said cylindrical bore;
- a toroidal coupling element fixed on said soleplate and providing articulated coupling between said soleplate and said toroidal part;
- energy absorption means disposed between the first or second cylindrical outside surfaces of said toroidal part and the surface of said vehicle A or B facing said first or second outside surface; and
- shear means holding said support part to longitudinal translation means fixed to said support arm connected to said other vehicle B.

The articulated coupling of the invention may also satisfy at least one of the following characteristics:

- the energy absorption means are disposed between said second cylindrical outside surface of the upper portion of said toroidal part and said facing surface of said other vehicle B;
- at least one energy absorption means is disposed between at least one outside surface of the upper portion of the toroidal part and a respective one of the facing surfaces of vehicle A;
- the energy absorption means are constituted by a sheet metal structure made of a material selected from: ordinary steel; stainless steel; an aluminum alloy; and a combination of said steels and/or alloys;
- the energy absorption means are honeycomb structures made of a material selected from: ordinary steel, stainless steel, an aluminum alloy, and combination of said steels and/or alloys;

the energy absorption means are spring type elements combining rubber and metal;

the energy absorption means comprise a succession of structures of progressively differing stiffnesses;

the energy absorption means are made of a visco-elastic material received inside cavities made of a material selected from: ordinary steel, stainless steel, and aluminum alloy;

the shear means are made of safety bolts, with the number of bolts depending on the force to be absorbed, and serving to prevent longitudinal translation of the support part along the support arm;

the shear means include lines of weakness;

the longitudinal translation means are constituted by means selected from: rails, rolling paths, and slideways; and the longitudinal translation means include, at one end, means for limiting the stroke of the support part along the support arm and preventing the bodies of the vehicles from separating while the train is being pulled after the shear means have sheared.

The invention also provides a method of absorbing energy between two vehicles, in particular rail vehicles, wherein:

a toroidal coupling element absorbs the energy induced by the forces caused by normal traction or braking of the train;

the toroidal coupling element and energy absorption means absorb the energy induced by forces due to minor shocks caused by trains being coupled together at speeds slightly in excess of an authorized speed; and the toroidal coupling element and the energy absorption means absorb the energy induced by forces due to violent shocks caused by minor collisions or by trains being coupled together at unauthorized speeds without damaging the toroidal coupling element because the shear means co-operating with the longitudinal translation means are sheared.

BRIEF DESCRIPTION OF THE DRAWINGS

Other objects, characteristics, and advantages of the invention appear on reading the following description of the preferred embodiment of the articulated coupling between two rail vehicles, which description refers to the accompanying drawings, in which.

MORE DETAILED DESCRIPTION

Figure 1:
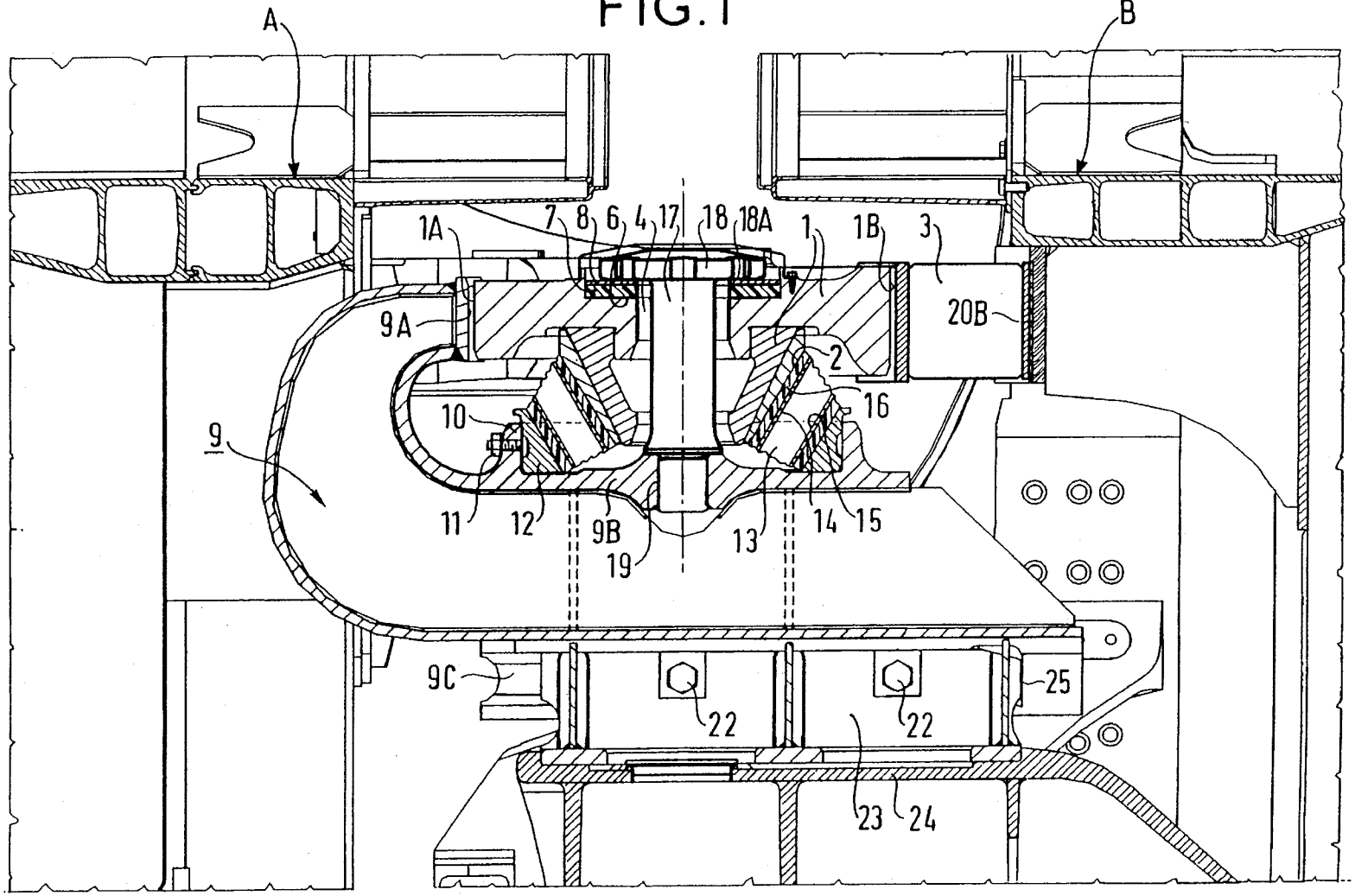
FIG. 1 is a section on a longitudinal plane of symmetry through an articulated coupling of the invention.

FIG. 1 is a section view on a longitudinal plane of symmetry through an articulated coupling of the invention.

Figure 2:
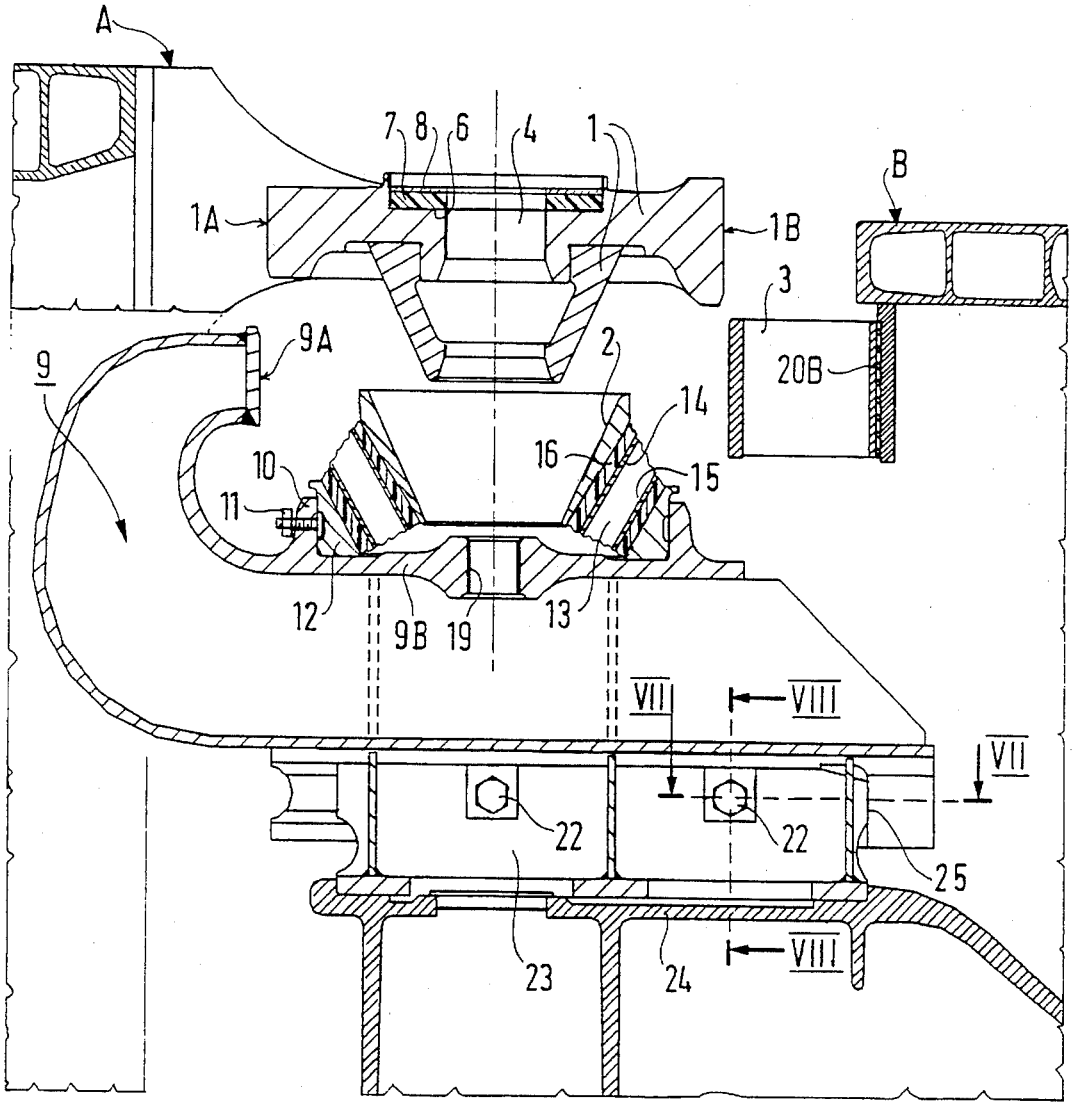
FIG. 2 is a simplified exploded view in section on the same longitudinal plane of symmetry as FIG. 1, showing an articulated coupling of the invention.

FIG. 2 is a simplified exploded view on the same longitudinal plane of symmetry as FIG. 1 showing the articulated coupling of the invention.

In accordance with the general principle of the invention, the articulated coupling between two vehicles A and B (e.g. rail vehicles) includes energy absorption means 3 disposed between one and/or the other of the two rail vehicles A and B and an element constituting the articulated coupling.

FIGS. 1 and 2 show a preferred embodiment of the articulated coupling of the invention. Other embodiments of the articulated coupling and applying the principle of the invention are possible, and some are outlined at the end of the description.

In FIGS. 1 and 2, the coupling comprises a central toroidal part 1 connected to the body of one of the vehicles A, having a frustoconical bearing surface 2 that bears against a resilient toroidal coupling element 13. Its top portion includes a first cylindrical outside surface 1A that faces a cylindrical outside surface 9A of a soleplate 9B secured to the body of the adjacent vehicle B, but spaced apart therefrom. Its top portion also includes a second cylindrical outside surface 1B facing a plane outside surface 20B of an element of the vehicle B.

The toroidal part is pierced by a bore 4 and has a hole 5 in its center. In the center of its top portion, a circular shoulder 6 is provided with elastomer elements 7 supporting a circular steel ring 8 whose top surface is polished. The toroidal part 1 may be a single part, or it may be made up of two or three parts.

The soleplate 9B connected to the body of the adjacent vehicle B is made up of a plurality of welded-together elements. The soleplate 9B comprises a cylindrical vertical rim 10 to which a circular part 12 of triangular right section for supporting the toroidal coupling element 13 is fixed by nut-and-bolt fasteners such as 11. By way of example, the toroidal coupling element 13 is made up of metal plates 14 sandwiched between layers of resilient material 15. A frustoconical plate 16 constitutes the bearing surface for the outside of the lower portion of the toroidal part 1.

A vertical pivot 17 is fixed to the center of the soleplate 9B by means of a thread 19 and engages in the bore 4 of the toroidal part 1 while leaving considerable clearance in said bore. This clearance is sufficient to ensure that the outside of the pivot does not come into contact with the bore during normal longitudinal displacements during traction or braking, and can only come into contact therewith during exceptional shocks. The upper portion of said pivot forms a circular cap 18 that has a plane bottom surface 18A facing the circular ring of polished hard metal 8 on the toroidal part 1.

According to an essential characteristic of the articulated coupling of the invention, energy absorption means 3 are disposed between the upper portion of the toroidal part 1 and the facing upper portion of the support part 9. These energy absorption means 3 are disposed between the second outside cylindrical surface 1B of the toroidal part 1 and the surface 20B of the vehicle B facing the second surface 1B.

In addition, shear means 22 co-operating with longitudinal translation means 23 are disposed between the support part 9 and a support arm 24. The support 24 is connected to vehicle B. The shear means 22 hold the support part 9 relative to the longitudinal translation means 23. The longitudinal translation means 23 are fixed to the support arm 24.

The ends of the longitudinal translation means 23 and of the support part 9 have surfaces such that they constitute a transverse abutment 25. The function of the transverse abutment is to limit the stroke of the support part 9 along the support arm 24 and to prevent the bodies of the vehicles from separating when the train is pulled after the shear means 22 have sheared.

The toroidal part 1 is undeformable and both of its surfaces form stops. The toroidal part 1 is calibrated as a function of the type of rolling stock on which it is mounted. By way of example, the strength of the toroidal part may lie in the range 20 kN to 3000 kN. The toroidal part may be made of steel, titanium alloy, aluminum alloy, or composite materials.

The energy absorption means 3 mounted at the end of vehicle B absorb energy. This energy absorption can take place while the vehicles are in a straight line or on a curve, and also while the vehicles are going over dips and humps in the track.

The energy absorption means 3 are elements that come into play only when the longitudinal forces exceed normal operating forces.

The energy absorption means may be made of materials having high elongation coefficients and a large gap between elastic limit and ultimate breaking limit so as to absorb a maximum amount of energy without risk of breaking and starting from the beginning of a shock.

By way of example, the energy absorption means 3 may be structures made of ordinary steel, of stainless steel, of aluminum alloy, said structures constituting honeycomb, or sheet metal structures, or structures combining the above-mentioned steels and/or alloys.

The longitudinal translation means 23 co-operate with the support part 9, e.g. by means of rails, of running tracks, or of slideways 9C.

Figure 3:
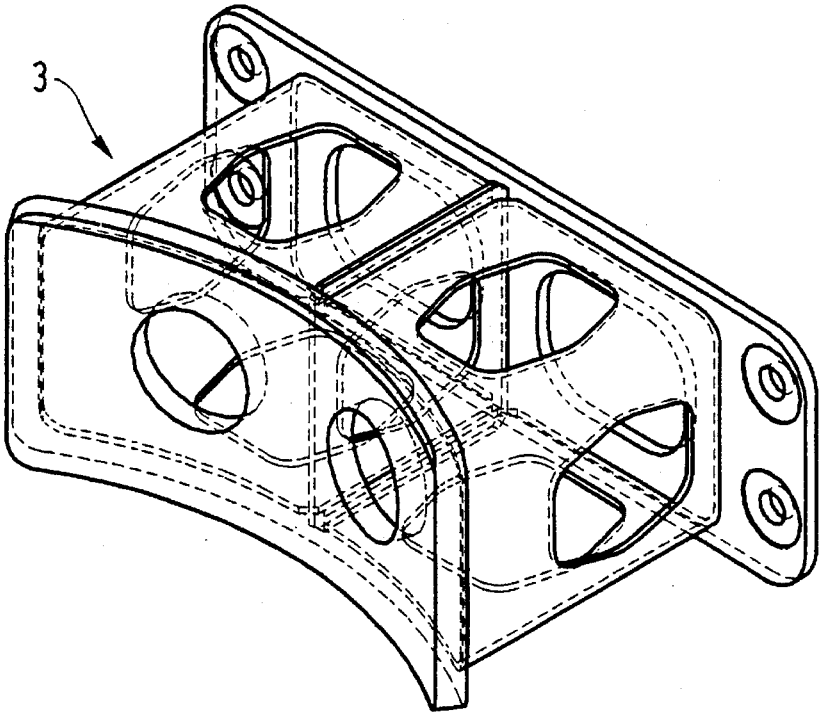
FIGS. 3 to 6 show various embodiments of the energy absorption means in an articulated coupling of the invention.

FIG. 3 shows a first embodiment of the energy absorption means 3 constituted by a sheet metal structure.

Figure 4:
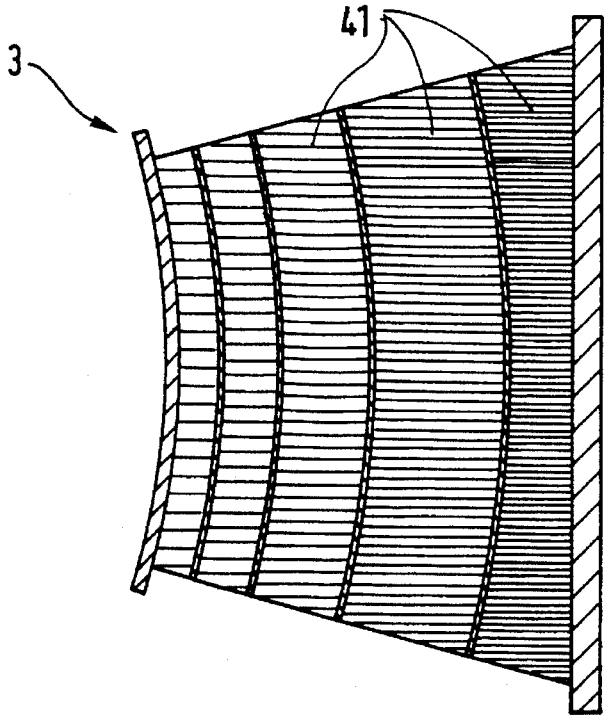

FIG. 4 shows a second embodiment of the energy absorption means 3 constituted by a composite structure of successive multiple honeycomb layers 41 of progressively differing stiffnesses.

The energy absorption means may also be made from spring type elements combining rubber and metal.

Figure 5:
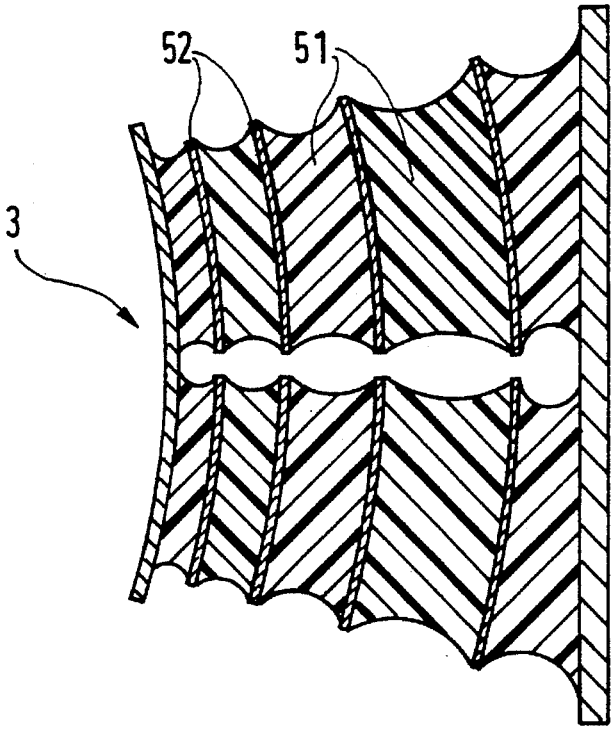

FIG. 5 shows a third embodiment of the energy absorption means 3 constituting a composite structure of successive multiple layers of rubber 51 and metal 52, the layers being of progressively different stiffnesses.

The energy absorption means may also be constituted by a visco-elastic material received inside a cavity made of ordinary steel, of stainless steel, or of aluminum alloy.

Figure 6:
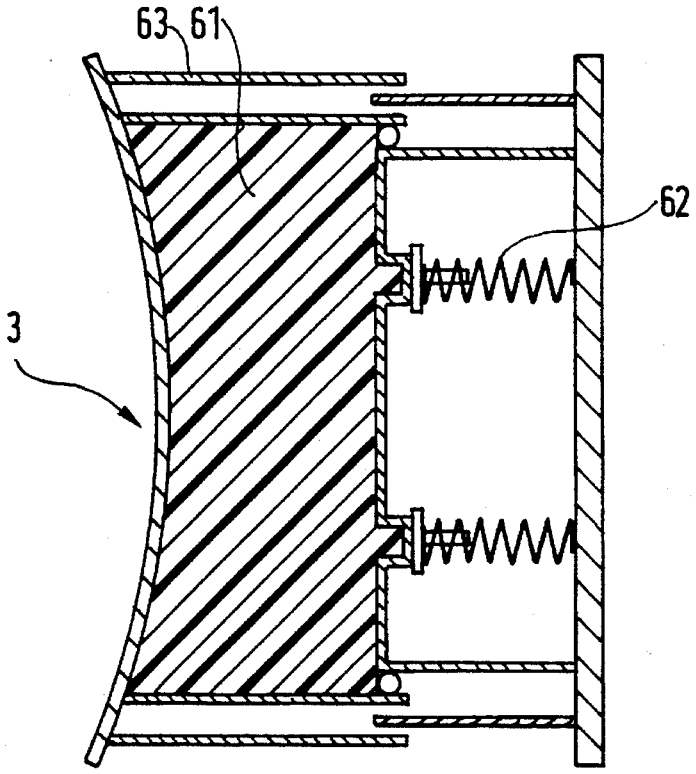

FIG. 6 shows a fourth embodiment of the energy absorption means 3 that comprises an elastomer structure 61 disposed in a sliding cavity 63 that co-operates with at least one spring 62.

These various embodiments ensure that the energy absorption means deform progressively in an appropriate manner while absorbing energy.

The energy absorption means are preferably dismountable. In particular, it is preferable to leave clearance in normal operation between the energy absorption means and the toroidal part.

Figure 7:
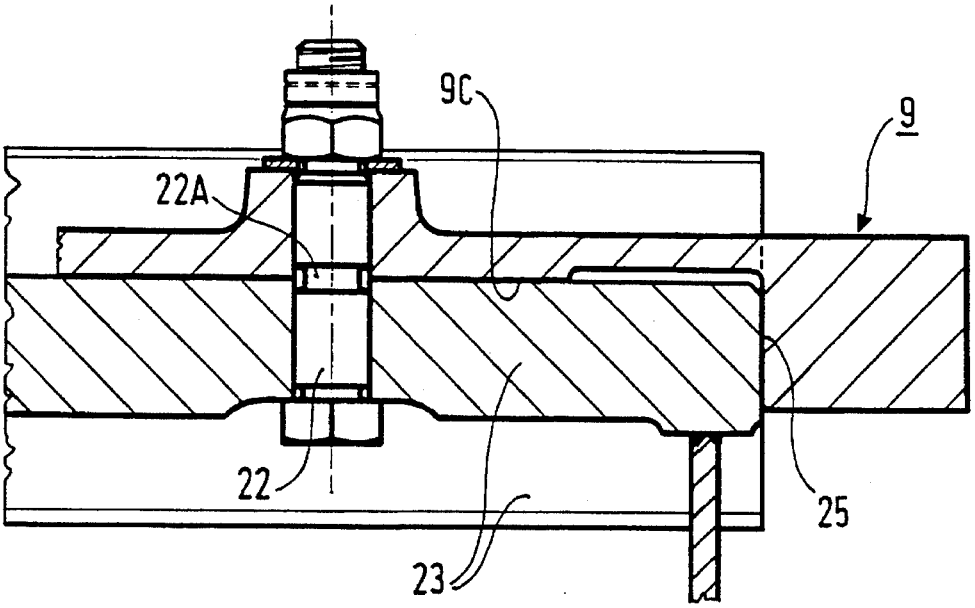
FIGS. 7 and 8 are a horizontal and a cross-section respectively through shear means that co-operate with longitudinal translation means of the articulated coupling of the invention.
Figure 8:
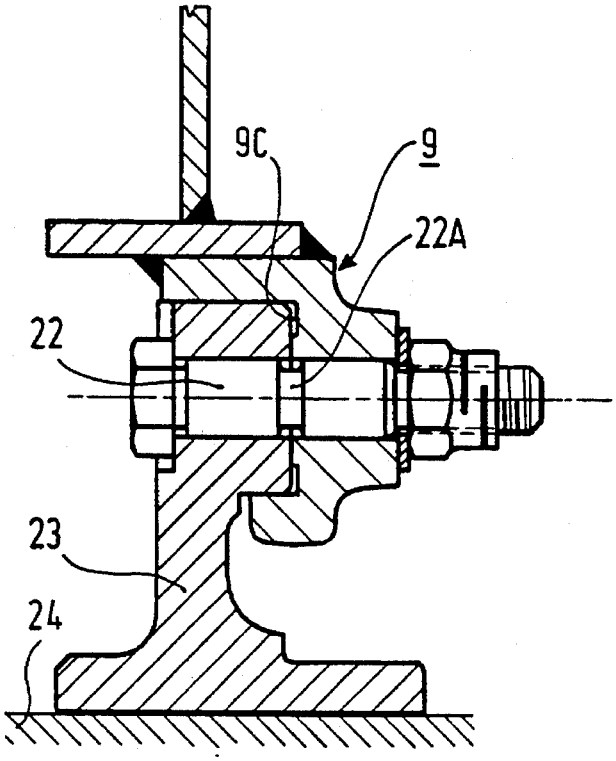

FIGS. 7 and 8 are respectively a horizontal section and a cross-section through the shear means 22 co-operating with the longitudinal translation means 23 and the support part 9 of the articulated coupling of the invention.

By way of example, the shear means 22 comprise some variable number of safety bolts depending on the force to be absorbed. The shear means 22 may have lines of weakness 22A.

These shear means 22 prevent the support part 9 moving in longitudinal translation along the support arm 24.

The transverse abutment 25 allows the longitudinal translation means 23 to move along the slideway 9C of the support part 9 in one direction only during energy absorption.

Figure 9:
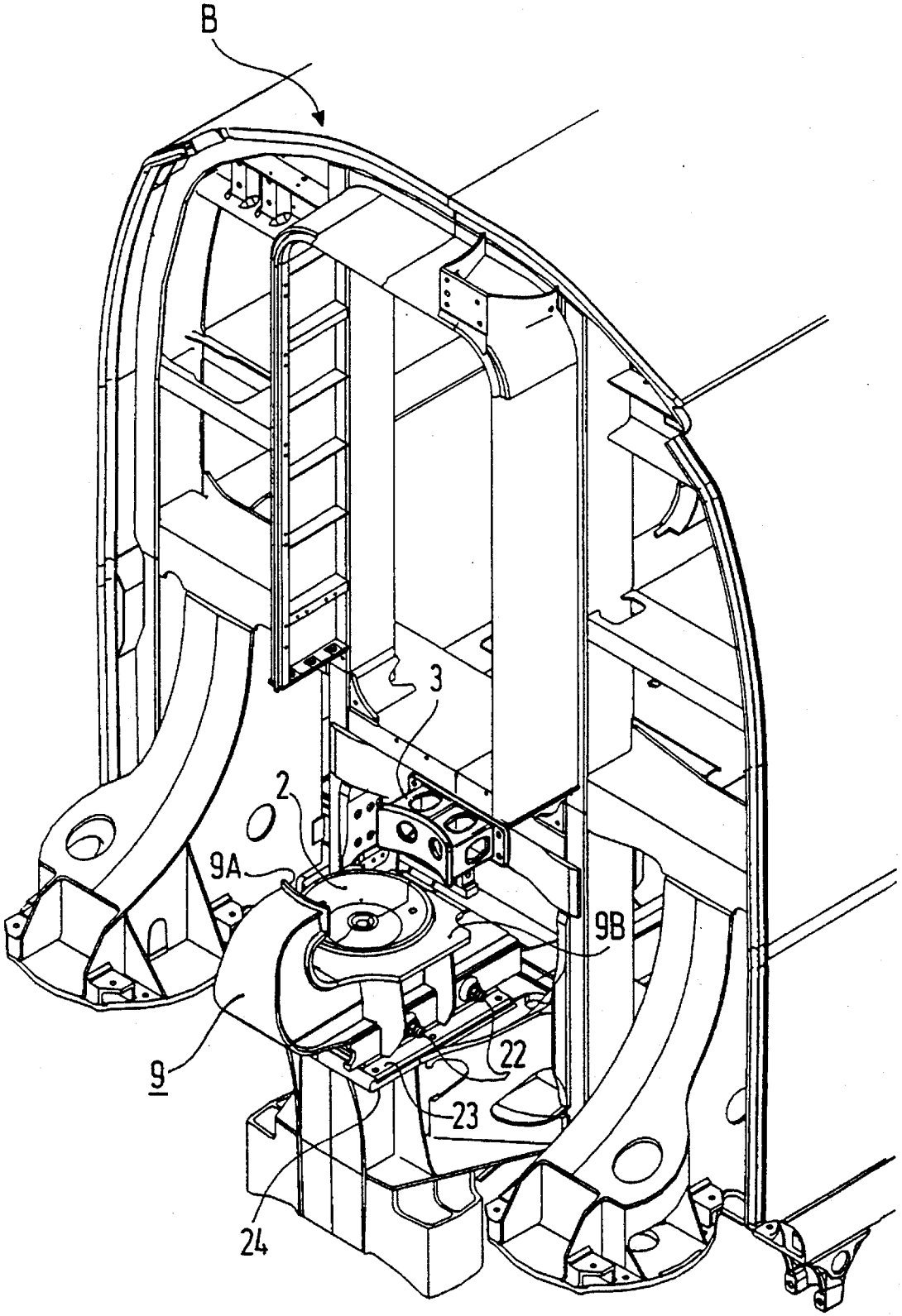
FIG. 9 is a perspective view of the carrying end of the body of vehicle B including a support part for the articulated coupling of the invention.

FIG. 9 is a perspective view of the carrying end of the body of vehicle B that includes a support part for the articulated coupling of the invention.

Figure 10:
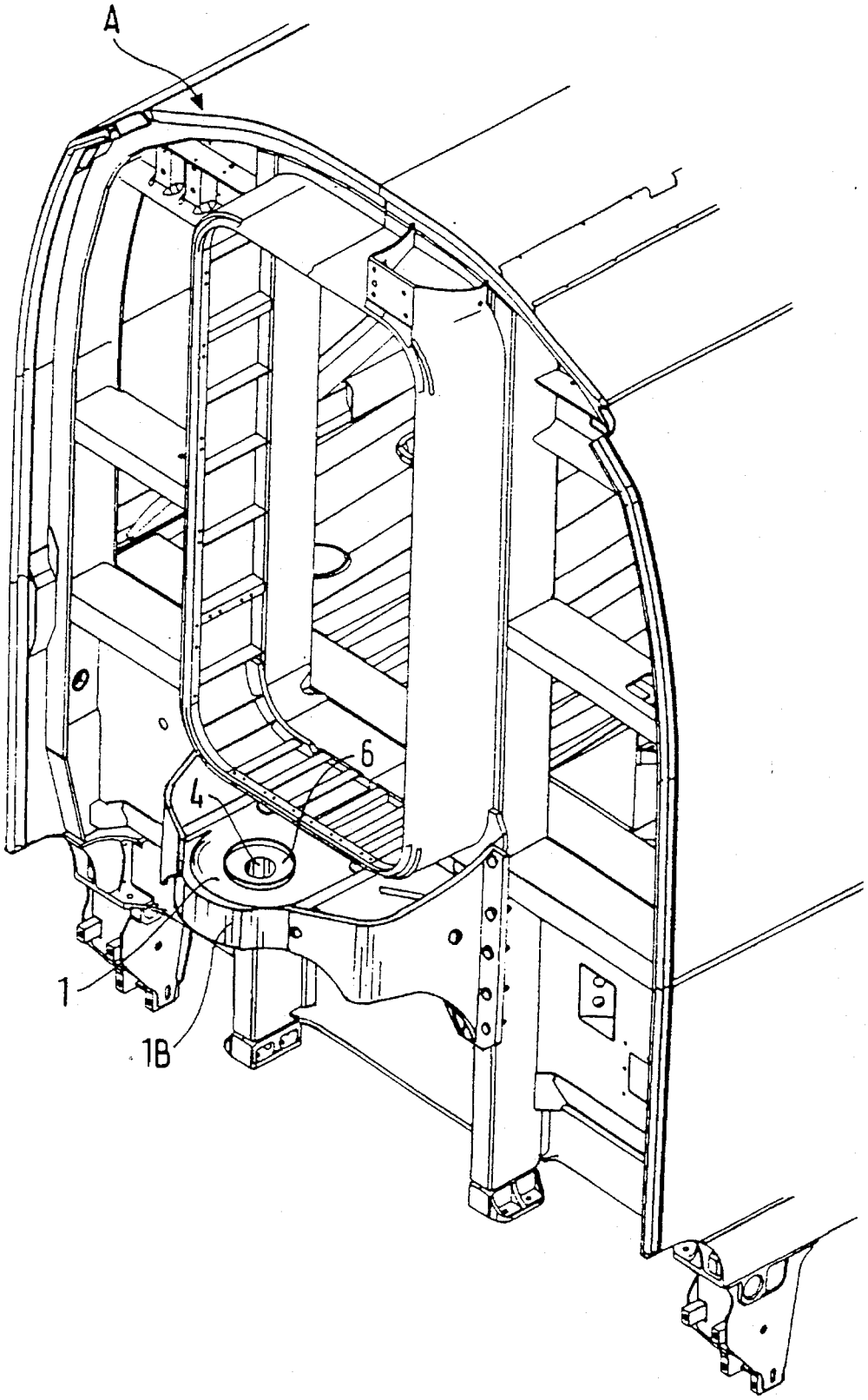
FIG. 10 is a perspective view of the supported end of the body of vehicle A including a toroidal articulated coupling part of the invention.

FIG. 10 is a perspective view of the supported end of the body of vehicle A that includes a toroidal part of the articulated coupling of the invention.

Figure 11:
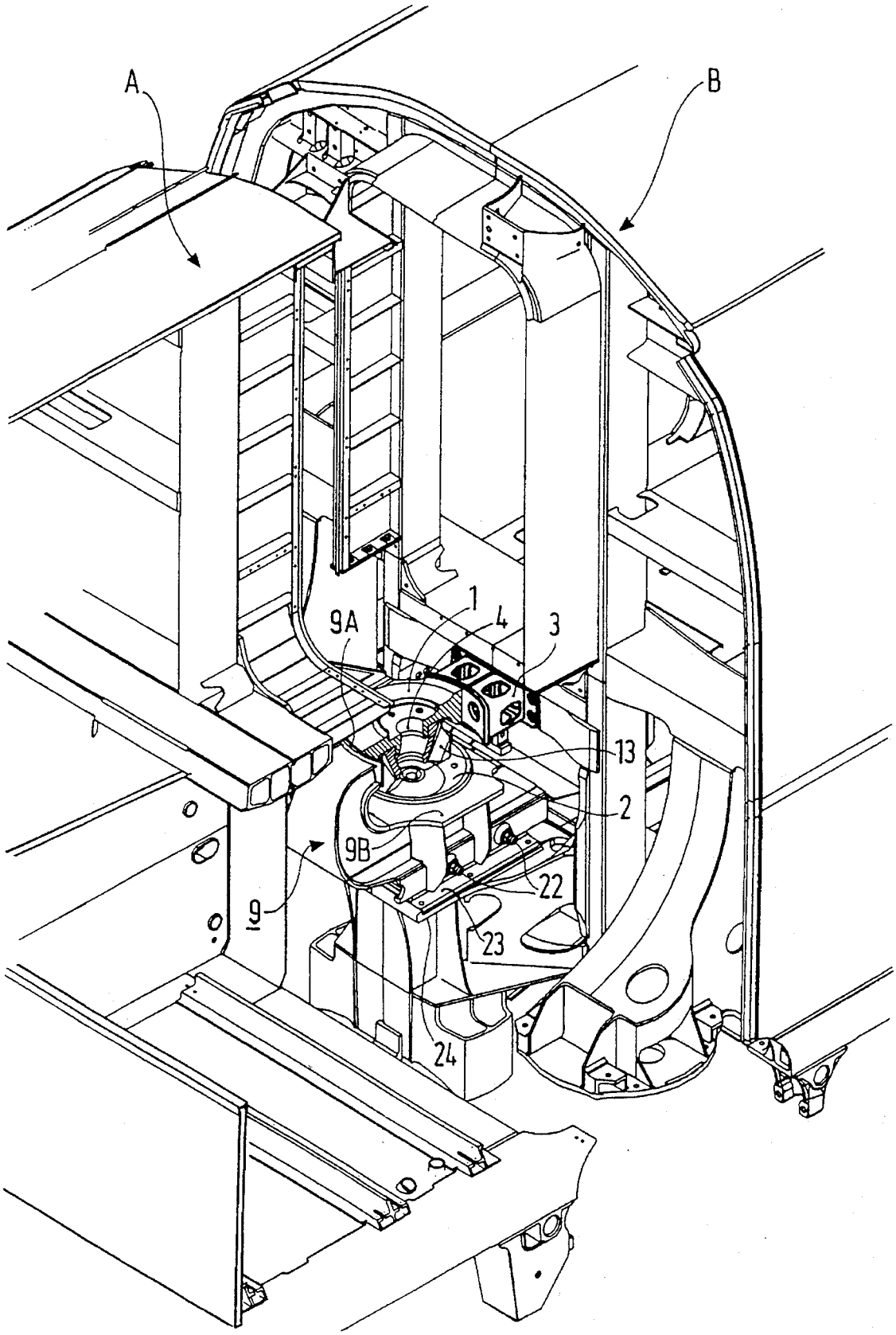
FIG. 11 is a partially cutaway perspective view of the carrying end and the supported end of two vehicle bodies, together with an articulated coupling of the invention.

FIG. 11 is a perspective view of the entire articulated coupling of the invention.

In FIGS. 9, 10, and 11, there can be seen the toroidal part 1 connected to one of the vehicles A, the support part 9 connected to the other vehicle B, the energy absorption means 3 disposed between the upper portion of said toroidal part 1 and the facing upper portion of said support part 9, and the shear means 22 holding the support part 9 securely to the longitudinal translation means 23 which are fixed to the support arm 24 connected to vehicle B.

The absorption of the energy induced by normal forces caused by traction or by braking of the train is performed by the toroidal coupling element 13. This first situation corresponds to normal operation and therefore nothing is damaged and no noise is generated.

The energy induced by forces due to minor shocks as caused by coupling trains together at speeds that are slightly greater than the authorized speed is absorbed by the toroidal coupling element 13 in association with the energy absorption means 3.

The energy induced by violent shocks as caused by minor collisions or by coupling trains together at unauthorized speeds likewise takes placed via the toroidal coupling element 13 and via the energy absorption means 3. Under such circumstances, the toroidal coupling element 13 is not damaged because the shear means that co-operate with the longitudinal translation means 23 are caused to shear. However, the energy absorption means 3 are damaged.

Figure 12:
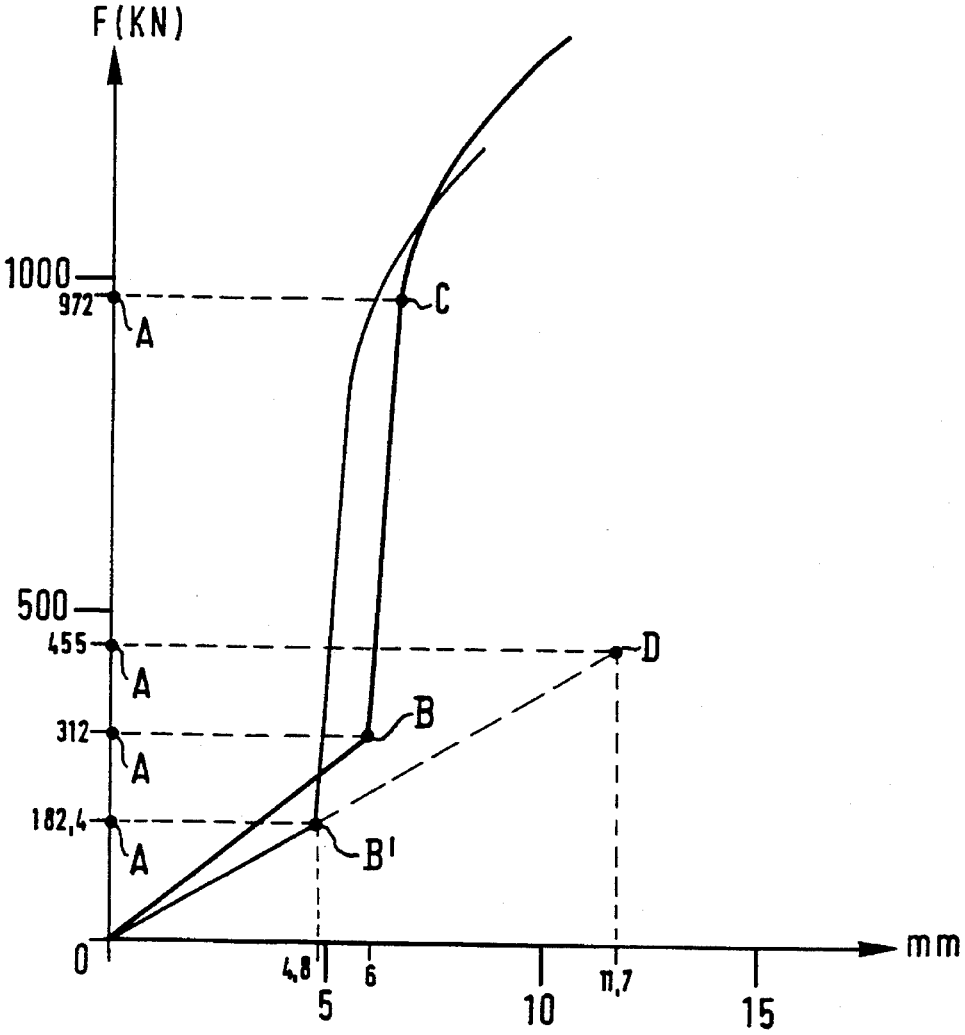
FIG. 12 is a graph of forces on the articulated coupling as a function of various values of longitudinal displacement.

FIG. 12 shows graphs of force in the articulated coupling as a function of different values of longitudinal displacement corresponding to the various cases mentioned above.

These force graphs show the operation of the articulated coupling, and in particular of the energy absorption means.

On the graphs, point A on the ordinate marks the maximum stroke AB and the minimum stroke AB' for which provision is made in normal operation of the articulated train during traction or braking. As mentioned above, there is no shock and no noise.

Maximum stroke AC is the design limit for operations in which bumping is involved. A shock occurs, for example, when the second cylindrical outside surface of the toroidal part is struck, however the energy is absorbed by the energy absorption means. As mentioned above, none of the components is damaged.

Stroke AD corresponds to the maximum displacement allowable after a violent shock for triggering the energy absorption means. The shear means and the transverse abutment are damaged.

After the energy absorbing means have operated, and thus also the shear means, the transverse abutments at the ends of the support part ensure that it is still possible to pull the train without any risk of the vehicles separating. For this purpose, the surfaces of the support part and of the longitudinal translation means constituting said abutment come into contact with each other.

Figure 13:
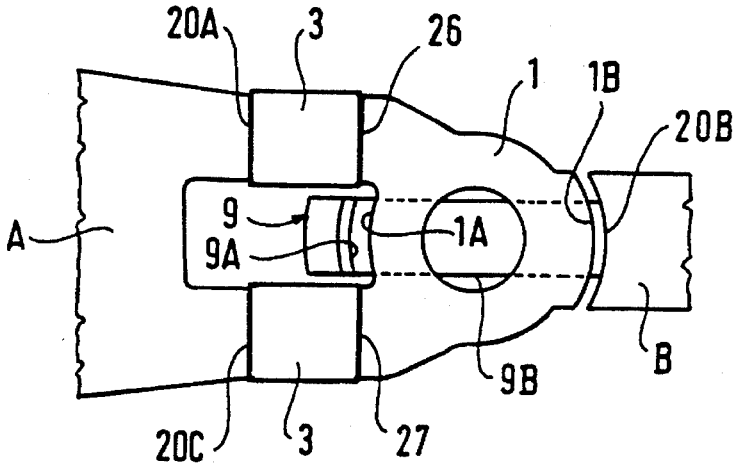
FIG. 13 is a fragmentary plan view in section of another embodiment of an articulated coupling of the invention.

Another embodiment of the articulated coupling, shown in FIG. 13, consists in placing two energy absorption means 3 between first and second outside surfaces 26 and 27 of the upper portion of the toroidal part 1, and respectively co-operating with first and second surfaces 20A and 20C of the vehicle A. The first and second outside surfaces 26 and 27 of the upper portion of the toroidal part 1 and the first and second surfaces 20A and 20C of the vehicle A are disposed facing one another in pairs.

Furthermore, the energy absorption means may also be disposed between the second cylindrical outside surface 1B of the upper portion of the toroidal part 1 and the surface 20B of the vehicle B in such a manner as to combine both of the above embodiments.

A first cylindrical outside surface 1A of the upper portion of the toroidal element 1 faces the cylindrical outside surface 9A of the soleplate 9B of the support part 9 which is secured to the body of vehicle B.

The invention also provides a method of absorbing energy between two rail vehicles.

According to the invention, the method of absorbing energy between two rail vehicles is such that:

the toroidal coupling element 13 absorbs the energy induced by the forces caused by normal traction or braking of the train;

the toroidal coupling element 13 and the energy absorption means 3 absorb the energy induced by forces due to minor shocks caused by coupling trains together at speeds slightly in excess of the authorized speed; and the toroidal coupling element 13 and the energy absorption means 3 absorb the energy induced by forces due to violent shocks caused by minor collisions or by coupling trains together at unauthorized speeds, without damaging the toroidal coupling element 13 because the shear means 22 co-operating with the longitudinal translation means 23 have sheared.

We claim:

1. An articulated coupling between two vehicles A and B, the coupling resting on a shared bogey between said two vehicles and comprising:

a toroidal part connected to one of the two vehicles, having a frustoconical surface in its lower portion, and a cylindrical surface in its upper portion, thereby defining first and second cylindrical outside surfaces, and including a cylindrical bore in its center;

a support part connected to the other of said two vehicles, including an inside cylindrical portion in its upper portion facing said cylindrical outside surface of the upper portion of said toroidal part and surrounding said toroidal part by means of a soleplate situated at a level below the level of said toroidal part;

a cylindrical pivot fixed on said soleplate and engaged in said cylindrical bore;

a toroidal coupling element fixed on said soleplate and providing articulated coupling between said soleplate and said toroidal part;

energy absorption means disposed between one of the first and second cylindrical outside surfaces of said toroidal part and the surface of said vehicle facing said first or second outside surface; and shear means holding said support part to longitudinal translation means fixed to a support arm connected to said other vehicle.

2. An articulated coupling according to claim 1, in which the energy absorption means are disposed between said second cylindrical outside surface of the upper portion of said toroidal part and said facing surface of said other vehicle B.

3. An articulated coupling according to claim 1, in which at least one energy absorption means is disposed between at least one outside surface of the upper portion of the toroidal part and a respective one of the facing surfaces of said one vehicle.

4. An articulated coupling according to claim 1, in which the energy absorption means are constituted by a sheet metal structure made of a material selected from the group consisting of: ordinary steel; stainless steel; an aluminum alloy; and a combination of said steels and/or alloy.

5. An articulated coupling according to claim 1, in which the energy absorption means are honeycomb structures made of a material selected from the group consisting of: ordinary steel, stainless steel, an aluminum alloy, and a combination of said steels and/or alloy.

6. An articulated coupling according to claim 1, in which the energy absorption means are spring elements of rubber and metal.

7. An articulated coupling according to claim 5, in which the energy absorption means comprise a succession of structures of progressively differing stiffnesses.

8. An articulated coupling according to claim 1, in which the energy absorption means are made of a visco-elastic material received inside cavities made of a material selected from the group consisting of: ordinary steel, stainless steel, and aluminum alloy.

9. An articulated coupling according to claim 1, in which the shear means are safety bolts, with the number of bolts depending on the force to be absorbed, and serving to prevent longitudinal translation of the support part along the support arm.

10. An articulated coupling according to claim 9, in which the safety bolts include lines of weakness.

11. An articulated coupling according to claim 1, in which the longitudinal translation means are constituted by one system selected from the group consisting of: rails, rolling paths, and slideways.

12. An articulated coupling according to claim 11, in which the longitudinal translation means include, at one end, means for limiting the stroke of the support part along the support arm and preventing the bodies of the vehicles from separating while the train is being pulled after the shear means have sheared.

13. An articulated coupling between two vehicles A and B, the coupling resting on a shared bogey between said two vehicles and comprising:

a first part connected to one of said two vehicles and defining at least one cylindrical surface, and including a cylindrical bore in its center;

a support part connected to the other of said two vehicles and defining at least one cylindrical surface facing said at least one cylindrical surface of said first part, said support part further including a soleplate situated at a level below the level of said first part;

a cylindrical pivot fixed on said soleplate and engaged in said cylindrical bore;

a coupling element fixed on said soleplate and providing articulated coupling between said soleplate and said first part;

energy absorption means disposed between said cylindrical surface of said first part and said at least one cylindrical surface of said support part; and shear means holding said support part to longitudinal translation means fixed to a support arm connected to said other vehicle.

14. An articulated coupling between two vehicles A and B supported on a common bogey between said two vehicles, said coupling comprising:

a toroidal part connected to one of the vehicles;

a support part connected to the other of said vehicles, a cylindrical pivot fixed on a soleplate of said support part and engaged in a cylindrical bore in a center of said toroidal part;

a toroidal coupling element fixed on said soleplate and providing articulated coupling between the soleplate and the toroidal part;

energy absorption means disposed between one of first and second cylindrical outside surfaces of said toroidal part and a facing cylindrical surface of said support part; and shear means holding said support part secure to a longitudinal translation system fixed to a support arm connected to said other vehicle, whereby said toroidal coupling element absorbs the energy induced by forces caused by normal traction or braking of the vehicles;

the toroidal coupling element and said energy absorption means absorb the energy induced by forces due to minor shock caused by said vehicles being coupled together at speeds slightly in excess of an authorized speed; and whereby the toroidal coupling element and the energy absorption means absorb the energy induced by forces due to violent shocks caused by minor collisions or by said vehicles being coupled together at unauthorized speeds without damaging the toroidal coupling element due to failure of said shear means cooperating with the longitudinal translation system.

15. A method of absorbing energy between two vehicles which are coupled by an articulated coupling, with the coupling resting on a shared bogey between the two vehicles, with the coupling comprising:

a toroidal part connected to one of the vehicles;

a support part connected to the other of the vehicles;

a cylindrical pivot fixed on a soleplate of the support part and engaged in a cylindrical bore of the toroidal part;

a toroidal coupling element fixed on the soleplate and providing articulated coupling between the soleplate and the toroidal part;

an energy absorption system disposed between one of first and second cylindrical outside surfaces of the toroidal part and a facing surface of the support part; and a shear means holding said support part secured to a longitudinal translation means fixed to a support arm connected to said other vehicle, said method comprising:

absorbing energy induced by forces caused by normal traction or braking of the vehicles by said toroidal coupling element;

absorbing the energy induced by forces due to minor shocks caused by the vehicles being coupled together at speeds slightly in excess of an authorized speed by said toroidal coupling element and said energy absorption means; and absorbing the energy induced by forces due to violent shocks caused by minor collision or by said vehicles being coupled together at unauthorized speeds without damaging the toroidal coupling element by shearing said shear means holding said support part to said longitudinal translation means fixed to said support arm connected to said other vehicle.

* * * * *